US005787970A

United States Patent [19]

Larinoff

[11] Patent Number: 5,787,970

[45] Date of Patent: Aug. 4, 1998

[54] AIR-COOLED VACUUM STEAM CONDENSER WITH MIXED FLOW BUNDLE

[76] Inventor: Michael W. Larinoff, 370 Holly Hill Rd., Oldsmar, Fla. 34677

[21] Appl. No.: 350,420

[22] Filed: Dec. 6, 1994

[51] Int. Cl.[6] ..... F28B 9/10

[52] U.S. Cl. ..... 165/111; 165/110; 165/900; 165/DIG. 222

[58] Field of Search ..... 165/110, 111, 165/910, 900, 134.1, DIG. 222

[56] References Cited

U.S. PATENT DOCUMENTS

| | | | |
|---|---|---|---|
| 686,432 | 11/1901 | Wolf | 165/111 |
| 3,710,854 | 1/1973 | Staub | 165/111 |
| 4,621,686 | 11/1986 | Ahn | 165/111 X |
| 4,926,931 | 5/1990 | Larinoff | 165/111 |
| 5,097,819 | 3/1992 | Talbert et al. | 165/111 X |

FOREIGN PATENT DOCUMENTS

| | | | |
|---|---|---|---|
| 528712 | 11/1972 | Switzerland | 165/111 |

*Primary Examiner*—Stephen M. Hepperle
*Assistant Examiner*—Christopher Atkinson

[57] ABSTRACT

There is disclosed a new and improved multi-row steam condensing bundle for use in air-cooled vacuum steam condensers employed in power plant applications and the like. Specific freeze protection design is directed to the first row of tubes in the bundle by employing blow-through steam. The excess steam that is not condensed in the first row is introduced into a second pass reflux row of tubes located in the protected warm air region of the bundle. All other tube rows in the bundle are of single pass design with divided rear headers except when the last two rows are configured in a similar two-pass arrangement that protects the exposed top tube row of the bundle from cold wind gusts. It is a mixed flow bundle design because some of the tube rows have counterflow steam and condensate while others have parallel flow.

3 Claims, 3 Drawing Sheets

AIR-COOLED VACUUM STEAM CONDENSER WITH MIXED FLOW BUNDLE

BACKGROUND OF THE INVENTION

1. Field of the Invention

The present invention relates to an air-cooled vacuum steam condenser and, more particularly, to an improved design of air-cooled heat exchange bundles as installed in air-cooled vacuum steam condensers serving steam turbine power cycles and the like operating over a wide range of steam loads and ambient air temperatures.

2. Description of the Background Art

All air-cooled vacuum steam condensers have common basic system elements such as the building block bundles, cooling ambient air supply, steam condensate collection and withdrawal system and an inert non-condensible gas collection and withdrawal system. This invention concerns the design and construction of the bundle unit. All the bundles used in this condenser are of the same design and construction which is a cost savings.

Nearly all prior art steam condensing bundles were designed with freeze protection as the number one priority. The bundles have anywhere from 1 to 3 passes and 1 to 5 tube rows of depth with the tubes constructed with extended surface heat-exchange fins. The insides of the tubes flow the steam to be condensed while the outside heat exchange surface contacts the ambient cooling air. The air is moved either by motor driven fans or natural draft towers.

The building-block bundles in some condensers may or may not be of identical construction throughout. Some designs employ two different sets of bundles that are joined to operate as a single unit. These bundles or sections are commonly called: main condenser, dephlegmator, vent condenser, reflux condenser, first-stage, second-stage, first pass, second pass, primary zone, secondary zone, first section, second section, etc.

No two prior art bundle designs are exactly alike. The differences are in their internal arrangements of the tubes such as single, two or three pass construction, some employing U-tubes. The rear headers may be open or divided and the tubes may be designed to be operated in a vertical or horizontal plane. Each design attempts to condense the steam, withdraw the condensate and non-condensible gases and safeguard the tubes from freezing.

There are earlier patents that reveal multi-row bundles with two pass construction that were designed for freeze protection. However, none of the prior art shows a bundle that has both single pass and two pass rows in the same bundle. Since the two pass rows have a tube length that is twice that of the single pass row, then what this means is that the bundle has a mixture of tube lengths which has not been done before. The reason this can be done is that each of the tube rows is handled as a separate condenser sub-bundle with its own condensate drain and gas withdrawal devices.

In this new bundle design the first row of tubes flows steam and condensate downward in parallel while the second pass reflux row flows the steam upward and condensate downward in counterflow mode. The remaining tube rows in the bundle are all of single pass construction with the fluids flowing downward in parallel into separate divided rear headers. Such building-block bundles are mounted vertically for natural draft air flow and in an A-frame configuration for mechanical draft employing motor driven fans.

The more common and obvious patents in this field are listed below along with a brief statement of the basic fluid-flow features of their bundles.

As evidenced by a large number of prior art patents, efforts are continuing to improve air-cooled vacuum steam condensers. Consider for example, U.S. Pat. No. 2,217,410 to Howard which shows a bundle of two-pass construction where the first pass consists of one group of tubes 19 and the second pass consists of another group of tubes 21.

The bundle design of Howard, U.S. Pat. No. 2,247,056, is the same as in '410.

U.S. Pat. No. 3,289,742, to Niemann discloses two different groups of single pass bundles. The main is parallel flow and the dephlegmator is counterflow, connected together with piping.

U.K. Patent Number 1,039,218 to Schulenberg is the same as Niemann '742.

U.S. Pat. No. 3,543,843 to Gunter which discloses that the bundle has four single pass rows with open rear headers and partial finning of tubes.

U.S. Pat. No. 3,556,204 to Dehne discloses a four-row two-pass bundle. Two rows are in parallel flow and two in counterflow.

U.S. Pat. No. 3,677,338 to Staub which discloses the bundle having four single pass tube rows in counterflow and partially finned tubes.

U.S. Pat. No. 3,705,621 to Schoonman discloses the bundle having four horizontal rows made up of two U-tubes.

U.S. Pat. No. 3,707,185 to Modine discloses a bundle of single pass construction with open rear headers.

U.S. Pat. No. 3,710,854 to Staub discloses the bundle having basically the same as that disclosed in Staub '338.

U.S. Pat. No. 3,789,919 to Huber discloses a horizontal four row single-pass bundle with divided rear headers.

U.S. Pat. No. 3,807,494 to Ris shows a four row single-pass bundle with an open rear header.

U.S. Pat. No. 3,887,002 to Schoonman discloses four horizontal rows with two U-tubes and two sections, main and second.

U.S. Pat. No. 3,976,126 to Ruff is basically similar to Niemann, '742.

U.S. Pat. No. 4,129,180 to Larinoff discloses four single-pass rows with divided rear headers and a vent tube.

U.S. Pat. No. 4,168,742 to Kluppel discloses one single-pass row with a vent portion.

E.P.O. No. 0,050,699 to Paquet shows a five tube row arrangement with the first two rows in parallel flow, the third in counterflow, the fourth in parallel flow and the fifth in counterflow.

U.S. Pat. No. 4,177,859 Gatti discloses the bundle as having four single-pass rows of which the first three are parallel flow and the fourth is counterflow.

U.S. Pat. No. 4,190,102 to Gerz comprises two different sections. The first section is three row, single-pass, with parallel flow and the second section has the first row, single pass, parallel flow and rows 2 and 3 single-pass counterflow.

U.S. Pat. No. 4,202,405 to Berb discloses four horizontal rows made up of two U-tubes.

U.S. Pat. No. 4,240,502 to Larinoff which discloses four single-pass rows with divided rear headers and a vent tube plus a steam-heated condensate drain pot.

U.K. Patent Number 2,093,176A to Zanobini discloses the bundle having three horizontal rows with two U-bends.

German Patent Number DE 31058904A1 to Kelp are basically similar to Niemann '742.

U.S. Pat. No. 4,417,619 to Minami discloses a four row bundle of two-pass design with one row offsets made in the middle of the tubes.

U.S. Pat. No. 4,903,491 to Larinoff discloses four row, single pass, parallel flow, divided rear headers with suction spargers.

U.S. Pat. No. 4,905,474 to Larinoff discloses the bundle being four row, single pass, counterflow, divided rear headers with suction spargers.

U.S. Pat. No. 4,926,931 to Larinoff which discloses the bundle having four horizontal rows made up of two U-tubes.

U.S. Pat. No. 5,139,083 to Larinoff discloses a bundle that has single row tubes with some in parallel flow and others in counterflow.

As will become evident, the prior art does not provide the benefits and advantages attendant with the present invention.

Accordingly, it is an object of this invention to provide an operating improvement which overcomes the costly cold weather inadequacies of the prior art devices thereby making it a significant contribution to the advancement of the art.

The improvement claimed for this invention is the protection of the internal fluid flow of air-cooled steam condenser bundles from freezing by efficient and economic design means.

Another object of this invention is to provide an improved multi-row air-cooled bundle for steam condensing purposes which comprises a plurality of tubes in a bundle. The bundle has its tubes arranged in a plurality of columns of tubes and a plurality of rows of tubes. Each of the tubes is inclined with an upper end and a lower end. A two-pass row of tubes has its first-pass located in the first row of tubes for the downward passage therethrough of the steam and its condensate. Such first row of tubes is exposed to ambient air for movement therepast. The second-pass row of tubes are parallel with the first-pass row of tubes, for the upward passage therethrough of uncondensed steam flowing from the first-pass first row of tubes. Further provided is a front steam header adjacent to the upper ends of the tubes of the first-pass first row and for flowing additional steam from the upper ends of these tubes to the second-pass row of tubes. Also provided is a rear steam header adjacent to the lower ends of the bundle tubes for receiving steam from the lower ends of the tubes of the first-pass first row of tubes for feeding uncondensed stream upward into the second-pass row of tubes and for collecting the condensate from both the first-pass and second-pass rows. Also provided is a rear gas header adjacent to the upper ends of the second-pass tube row for the collection of non-condensible gases released in both the first and second-pass tube rows. A single-pass row of tubes is provided for the downward passage therethrough of the steam and its condensate. Such rows are installed in the internal warmed region of the bundle. A front steam header is provided adjacent to the upper ends of the tubes of the bundle supplying steam to the single-pass rows of tubes. A rear gas header is adjacent to the lower ends of the single-pass tube rows for collecting its condensate and non-condensible gases. Separate and isolated water leg seals are provided for the withdrawal of the condensate from each of the rear headers. Separate and isolated non-condensible gas is withdrawn from each of the rear gas headers where the steam condensing terminates.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

The invention is in the design of the steam/condensate/gas fluid-flow paths inside a multi-row bundle, the bundle being the basic heat-exchange building block used in the assemblage of steam condensers. The internal fluid flow design improvements concern the freeze protection of the bundle, particularly its first row that is exposed to fan-controlled cold ambient air and also its last row that is exposed to cold wind gusts. Some of the tube rows have counterflow steam and condensate while others have parallel flow.

Since the inception of air-cooled steam condensers, the major problem plaguing them has been the freezing of the condensate inside the finned heat exchange tubes. This freezing results in tube rupture, loss of turbine vacuum and the tripping of the turbine generator unit off the line. This is a costly mishap which in addition to causing a plant outage is also difficult to repair in cold freezing weather. All the damaged tubes must be either plugged or replaced before the turbine unit can be brought back on line.

Some of these freeze-mishaps are the result of mal-operation on the part of the plant operators and others are mal-design on the part of the manufacturers. Some condenser designs are more prone to freezing while others are safer. There has been considerable field experience with the freeze characteristics of air-cooled condensers the past 50 years so that certain design and construction features are recognized as being desirable and others as weak. To date, there is not a single air-cooled steam condenser design on the market that cannot be frozen. It is just that some bundles freeze easier and quicker than others. The improved bundle design in this invention takes advantage of the lessons learned from the successes and failures of the past.

There are several basic bundle designs that have evolved over the years. One favorite low-cost design employs single pass rows that terminate in separate rear headers. Its weakness lies in the problem that arises when the ambient air temperature drops quickly or the steam load lightens suddenly. When this happens the steam in the first row of tubes is completely condensed before it reaches the end of the tubes so that a void pocket is created at that point which rapidly fills with inert non-condensible gases. The upstream condensate from the condensed steam flows through these cold gas pockets in its travel to the rear header and freezes for lack of steam heat. The net result is damaged first row tubes.

The first row tubes can be protected by employing a blow-through design feature where more steam is designed to flow through the tubes than can be condensed. That which is not condensed enters a header and then flows into a second pass of reflux tubes. Now when the temperature drops or the steam load is lightened the second pass reflux tubes are denied a full tube of steam while the first row is still full and without gas pockets. But this does not present a freeze problem to the second pass reflux tubes because the condensate flow is counter to the steam flow. The condensate does not flow through any cold gas pockets but instead it flows against the steam and is dumped into the header that is the steam source.

The first row of tubes are protected by the use of a second pass reflux tube row. The first row of tubes is defined as the first tube row in the bundle that is contacted by the cold ambient air. The second pass "dephlegmator" can be a separate bundle as used in some patented designs or it can be incorporated into the higher tube rows of the same bundle. When installed in the same bundle as revealed in this invention, then it can be located in the second, third or fourth tube row depending upon a number of design conditions as discussed below.

First, the reflux tube row should preferably be located in a warm air zone of the bundle where the air temperature is above freezing, i.e., the warm air discharge from the first row and above. If it is not located in warm air as is the case for some patented designs then hoar frost forms in the upper interior sections of the tubes that can result in freeze damage. Reflux condensers and dephlegmators that have hoar frost build-up inside their tubes must be thawed by periodically stopping the fan motors for some five- to fifteen-minute periods. Stopping and restarting fan motors that frequently is hard on the gear box, motors and electrical switch gear. The new bundle design disclosed herein has its reflux tubes located in warm air inside the bundle so it is not faced with the freezing problems and thawing procedures required by some of the older condenser designs.

Second, it is important that the reflux tubes be installed in a row which flows enough but not too much steam. The higher the row is installed in the bundle, the higher is the air temperature and the less the condensed steam quantity. Hence, if the reflux tubes are installed in the second row, they will have the capability of condensing a lot of blow-through steam safeguarding the first row but the steam pressure drop across the tubes will also be high. A high internal pressure drop produces a poorer condenser vacuum that results in loss of power output and poorer plant thermal efficiency. In addition, the high steam and condensate loading of the reflux tubes during summer gives a lower heat transfer rate between the condensing steam and the cooling air. This requires more surface area and a larger and more costly condenser to do the job.

On the other hand, if the reflux tubes were installed in the fourth row rather than the second, then there would be less blow-through steam flowing and, therefore, less freeze protection for the first row. But the steam pressure drop across the tubes would be lower and this would improve the condenser vacuum, plant output and the plant thermal efficiency.

In addition to the above factors, there are other important considerations that must be weighed in selecting the reflux row location inside the bundle such as the slope of the tubes from the horizontal, the length of the tubes, the diameter of the tubes, the density of the fins along the tube length, the steam/condensate velocities and loading at the entrance to the second pass reflux tubes, the intensity of the cold ambient air temperature of the region, the magnitude of the winter winds and the steam load factors during the cold periods.

There is no one optimum location for the reflux tube row in the bundle that will satisfy all installations regarding operation, economics, first row protection and ambient conditions. Every situation must be examined in the light of its own circumstances and the decision then made as to where to install the reflux tubes: in the second, third or fourth row.

If the location of the plant is such that the very cold weather is accompanied by high winds, then it may be decided to go to the extreme and protect the exposed fourth row from the winds by installing the same blow-through steam feature that the first row has. This provides more freeze protection to the bundle but at a price cost.

The basic tube and its flat plate header as employed herein is a simple low-cost design. The same tube assembly is used for all reflux tube-row locations as revealed in this invention. The rear headers that are welded to the rear tube sheet and cover the ends of the tubes are the items that are different. The headers are of different construction not only for the second, third and fourth row reflux tube locations, but also if the bundles are built with 4, 3, 2 or 1 tube rows total. The design of these alternative headers are all shown in detail subsequently.

The condensate drains and the non-condensible gas removal systems are basically the same for all the various bundles header designs presented. The condensate drains pass through individual water-leg seals so that they do not interfere with each other. They are collected and flow into a common piping manifold system connected to the condensate hot-well tank. The non-condensible gas removal system collects the gases from all the bundle rear headers using individual first-stage steam ejectors which isolate each of the rows from each other.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several Figures.

DETAILED DESCRIPTION OF THE PREFERRED EMBODIMENT

Figure 1:
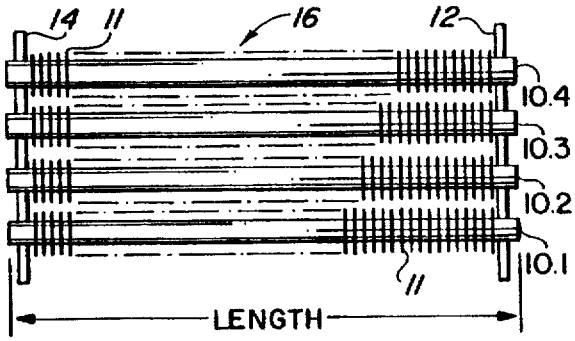
FIG. 1 shows a side view of the construction of a four row basic building-block bundle as employed in all the design variations revealed in this invention.

With reference now to the drawings, and in particular to FIG. 1 thereof, a new and improved air-cooled vacuum steam condenser with mixed flow bundle embodying the principles and concepts of the present invention will be described.

The present invention, the new and improved air-cooled vacuum steam condenser with mixed flow bundle, is comprised of a plurality of components. Such components are individually configured and correlated with respect to each other so as to attain the desired objective.

Overview

This invention relates to the design and construction of heat exchange bundles 16 that are used in air-cooled vacuum steam condensers employed in the exhaust systems of power plant type steam turbines. The bundles 16 are generally arranged in two banks in an A-frame configuration at about a 60° angle similar to the single bank shown in FIG. 3. A forced draft fan at the bottom of the A-frame moves the ambient cooling air 50 through the bundles 16 condensing the steam. In a natural draft configuration the bundles would be positioned vertically around the circumference of the tower at grade elevation. The bundle 16 receives the turbine exhaust steam through steam supply headers 18, the cooling air 50 condenses it and the heated air 52 is discharged into the atmosphere. The condensate is collected from each of the rear headers 22.1, 22.2, 22.3, 22.4 by drain pipes 26.1, 26.2, 26.3, 26.4 and is removed by water-leg seals 28 that isolate each of the drains since they are all at different steam pressure levels. Note FIGS. 11 and 12. The non-condensible gases are evacuated from the rear headers 20 by piping 24.2, 24.3, 24.4 connected to first-stage steam jet evacuators 40.2, 40.3, 40.4, note FIG. 13, and 40.5, note FIG. 14. The non-condensible gases are evacuated by separate ejectors from each of the rear headers because they also are all at different fluid pressure levels.

Basic Bundle Design

Figure 2:
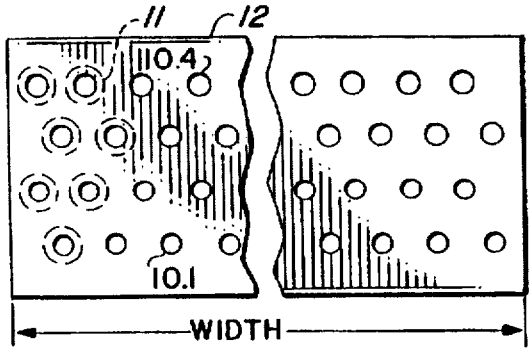
FIG. 2 is an end view of the bundle looking into the tube sheet and the ends of the heat exchange tubes.

A four row basic bundle 16 design is shown in FIGS. 1 and 2. Each of the four rows have finned 11 tubes 10.1, 10.2, 10.3, 10.4 that are welded to a front tube sheet 12 and a rear tube sheet 14. The length of the finned tubes shown in FIG. 1 is generally in the range of 20 to 40 feet while the width of the bundle shown in FIG. 2 does not exceed about 12 to 14 feet. A rear header 20 is welded on the front tube sheet 12 end then a steam supply header 18 is welded covering it. The rear tube sheet 14 has different arrays of rear headers that are welded to it depending on the amount of refluxed steam sought.

Four Row Bundle

Figure 3:
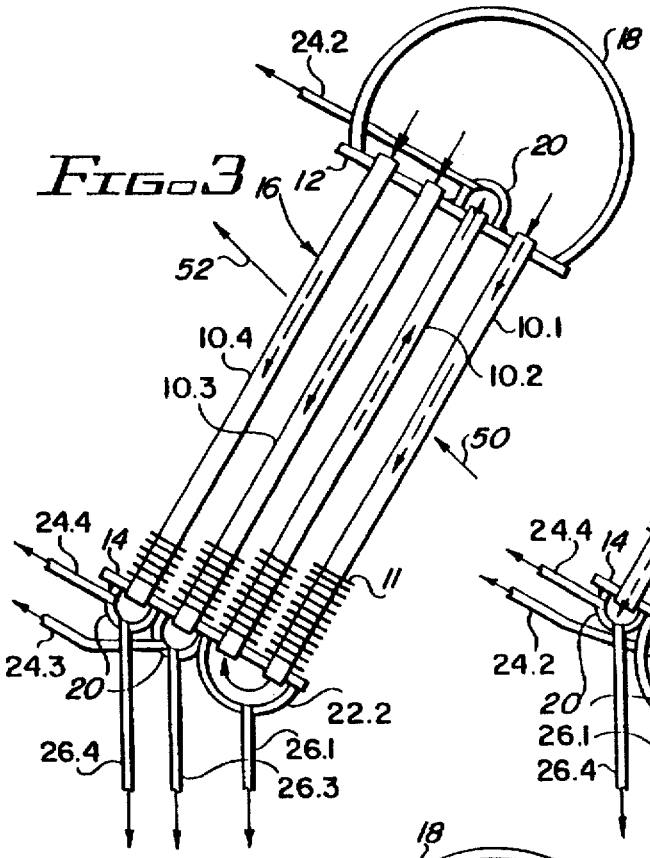
FIG. 3 shows a four row bundle with the second pass reflux tube row located in the second row of the bundle.

The greatest amount of second pass refluxed steam protecting the first tube row 10.1 is achieved by making it the second row 10.2 of the bundle 16 shown in FIG. 3. Rear header 22.2 welded to the rear tube sheet 14 directs the uncondensed steam leaving the first row 10.1 into the second row 10.2. The steam and condensate flow in parallel in the first row 10.1 and in counterflow in the second row 10.2. All of the condensate from these two rows flows into the bottom of the rear header 22.2 and is then piped out 26.1 of the system. The non-condensible gases are removed from the rear header 20 by piping 24.2. The third row 10.3 and fourth row 10.4 are isolated from each other with their steam and condensate flowing in parallel. Their rear headers 20 are welded to the rear tube sheet 14 and their condensate is drained by piping 26.3, 26.4 and non-condensible gases withdrawn by piping 24.3, 24.4.

Figure 4:
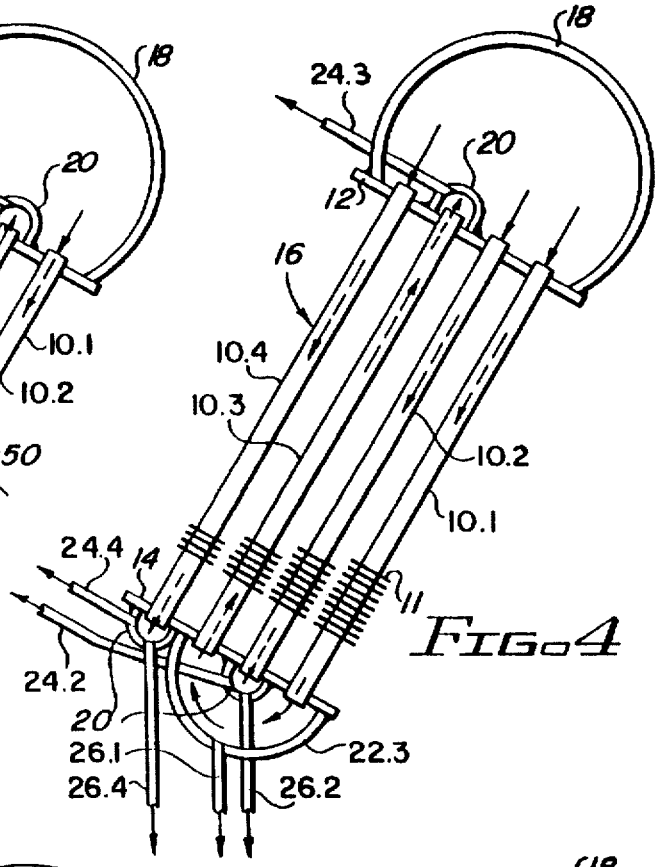
FIG. 4 shows a four row bundle with the second pass reflux tube row located in the third row of the bundle.

The second largest amount of refluxed steam is achieved by making it the third row 10.3 of the bundle 16 as shown in FIG. 4. The rear header 22.3 that is welded to the rear tube sheet 14 directs the uncondensed steam leaving the first row 10.2 into the third row 10.3. The second row 10.2 and the fourth row 10.4 are isolated single pass rows with their steam and condensate flowing in parallel. The condensate is drained through pipes 26.1, 26.2, 26.4 and the non-condensible gases through pipes 24.2, 24.3, 24.4.

Figure 5:
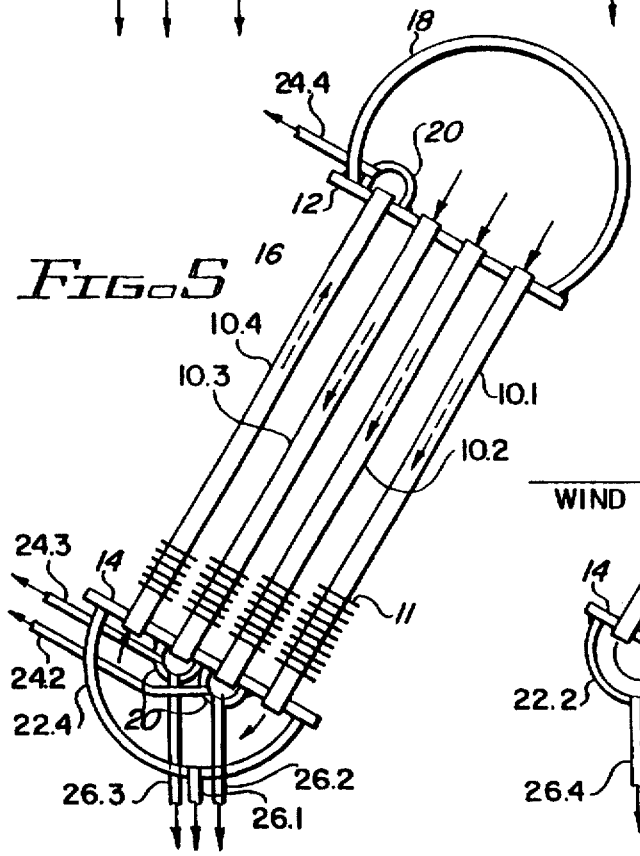
FIG. 5 shows a four row bundle with the second pass reflux tube row located in the fourth row of the bundle.

The least amount of refluxed steam flowing uncondensed through the first row 10.1 is achieved by installing it in the fourth row 10.4 of bundle 16 as shown in FIG. 5. The rear header 22.4 directs the uncondensed steam leaving the first row 10.1 into the fourth row 10.4. The second row 10.2 and the third row 10.3 are isolated single pass rows with their steam and condensate flowing in parallel. The condensate is drained through pipes 26.1, 26.2, 26.3, and the non-condensible gases through pipes 24.2, 24.3, 24.4.

Figure 6:
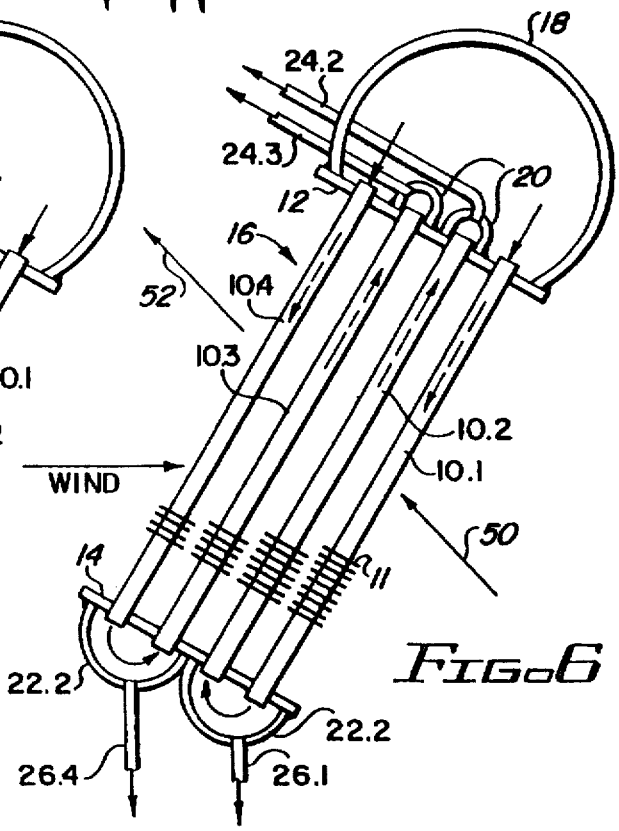
FIG. 6 shows a four row bundle with two second pass reflux tube rows located in the second and third rows of the bundle.

All of the above bundle designs aim at protecting the ends of the first row of tubes 10.1 by providing them with blow-through steam that flows into the second pass reflux tube row. The first row is guarded because it needs protection from the cold ambient air. The same need and protection also exist in some situations for the top row of tubes 10.4 that are exposed to cold wind gusts. This is an uncontrolled cold air flow that could be even more dangerous than fan controlled cold air flow that the first tube row 10.1 experiences. FIG. 6 shows a second pass reflux tube row installed in the third row 10.3 protecting the fourth row 10.4 similar to the protection given the first row 10.1. The condensate is drained through pipes 26.1 and 26.4 and the non-condensible gases through pipes 24.2 and 24.3.

Rear header designs shown in FIGS. 3, 4 and 5 all provide blow-through steam for the first tube row 10.1 with various degrees of steam flow depending on the design needs as was explained earlier. FIG. 6 design goes the ultimate step by first providing the largest amount of second pass refluxed steam for its first row 10.1 similar to FIG. 3 and then providing protection to the other face of the bundle tubes 10.4 that are exposed to the cold wind gusts. This is done, however, at an economic penalty by having two second pass reflux tube rows installed in the same bundle. The second pass reflux tubes 10.3, 10.4 with counterflow fluid (FIG. 6) have a poorer overall heat transfer rate than the parallel fluid flow single row tubes 10.3, 10.4, of FIG. 3.

Figure 7:
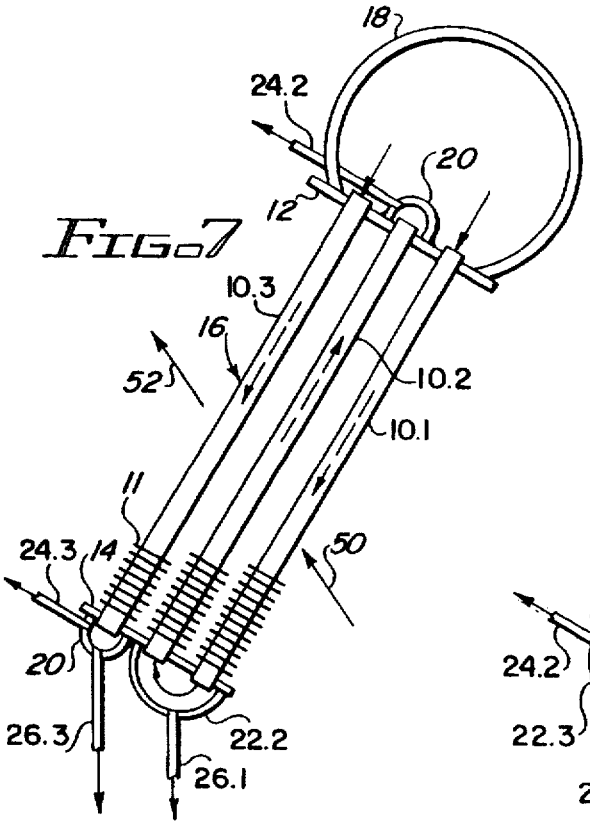
FIG. 7 shows a three row bundle with the second pass reflux tube row located in the second row of the bundle.
Figure 8:
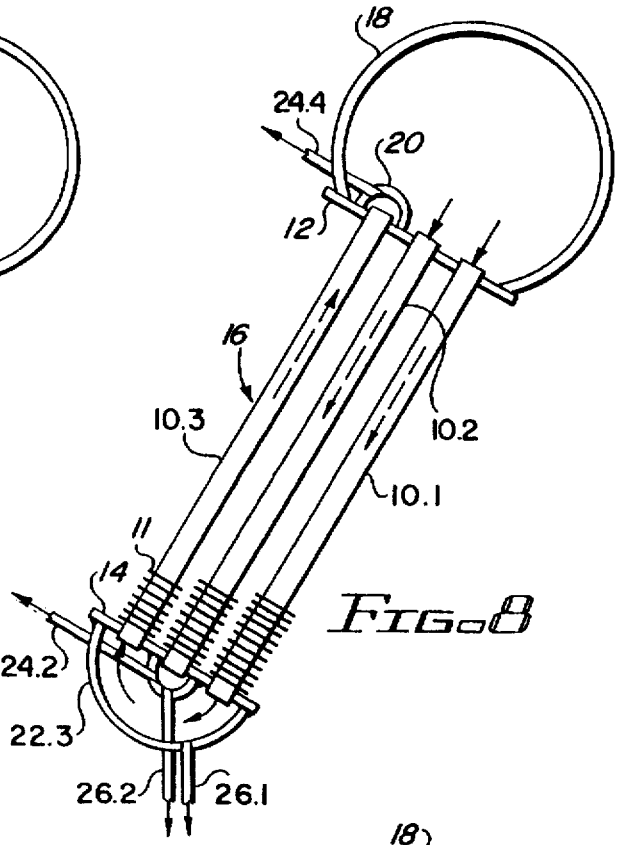
FIG. 8 shows a three row bundle with the second pass reflux tube row located in the third row of the bundle.

Three, Two and One Row Bundles A three row bundle with larger size tubes than those employed in a four row bundle is shown in FIGS. 7 and 8. FIG. 7 has the greatest amount of second pass refluxed steam when using the second row 10.2. The third row 10.3 is an isolated row with the steam and condensate flowing in parallel. The condensate is drained through pipes 26.1, 26.3, and the non-condensible gases through pipes 24.2 and 24.3.

The least amount of refluxed steam flows when it is installed in the third row 10.3 as shown in FIG. 8. The second row 10.2 is an isolated row with the steam and condensate flowing in parallel. The condensate is drained through pipes 26.1, 26.2 and the non-condensible gases through pipes 24.2, 24.4.

Figure 9:
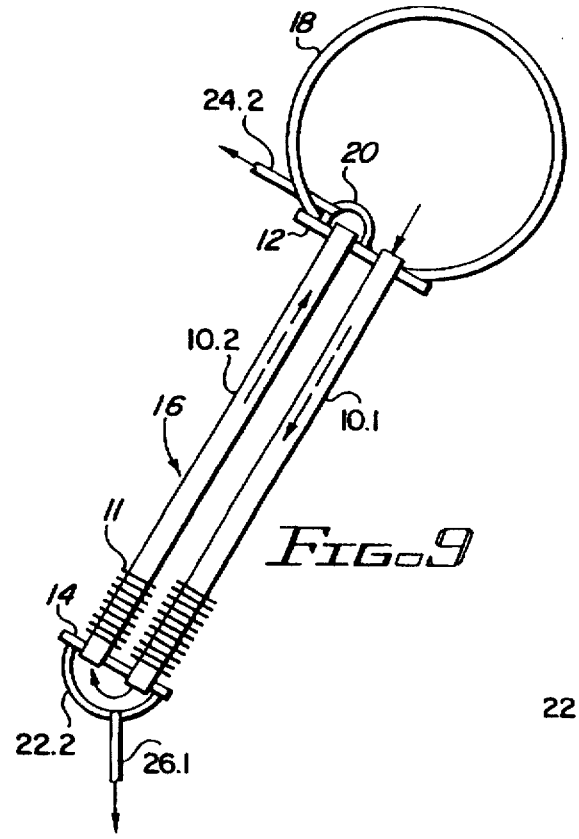
FIG. 9 shows a two row bundle with the second pass reflux tube row located in the second row of the bundle.

A two row bundle employing a second pass reflux row is shown in FIG. 9. The tubes in this bundle would in all probability be large oval shaped for increased air flow contact. The condensate is drained through pipe 24.2.

Figure 10:
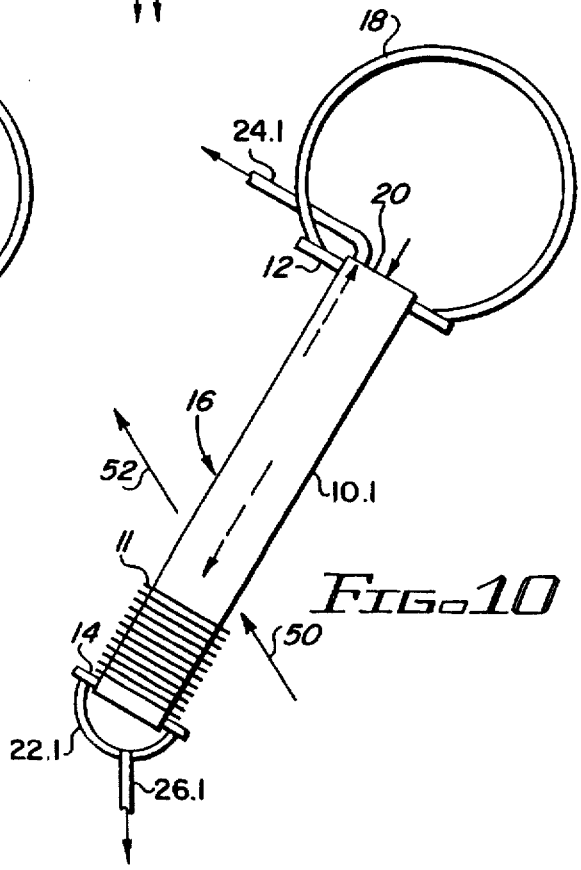
FIG. 10 shows a one row bundle with the second pass reflux tubes located between the first pass steam condensing tubes.

A single row tube bundle with second pass reflux tubes is shown in FIG. 10. The details of this bundle design with its large rectangular shaped tubes are revealed in U.S. Pat. No. 5,139,083 to Larinoff.

Fluid Removal

Figure 11:
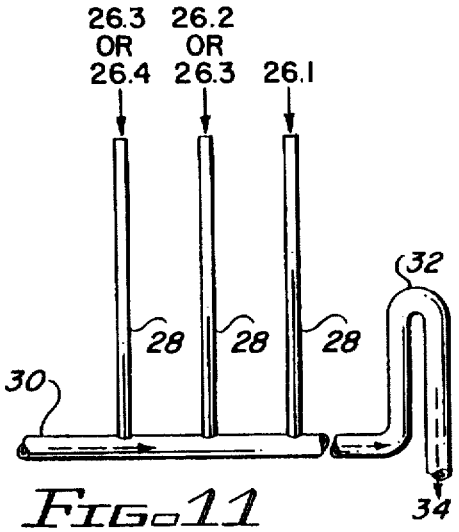
FIG. 11 shows typical water-leg seals used to isolate and drain the condensate from each tube row in the bundle.

Each tube row 10.1, 10.2, 10.3, 10.4 in bundle 16 has a different fluid pressure so that each must be handled individually and then equalized before combining. FIG. 11 shows how the condensate drains 26.1, 26.2, 26.3, 26.4 flow into individual water leg seals 28 before they are combined to flow into a common pipe header 30. A system pipe seal 32 maintains a common hydraulic pressure for all the water leg seals 28 before the condensate 34 flows into a storage tank.

Figure 12:
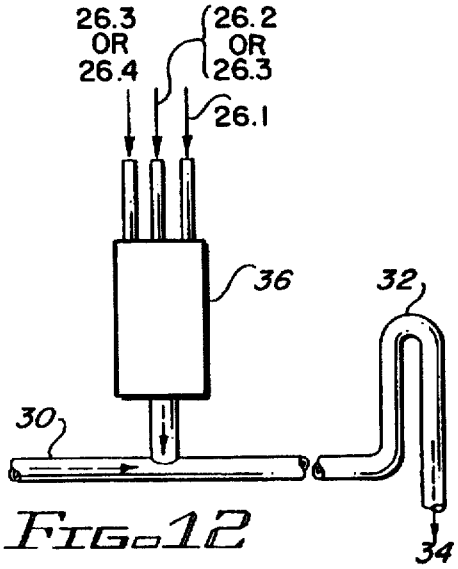
FIG. 12 shows the condensate water-leg seals installed in a steam-heated drain pot.

FIG. 12 shows a freeze protected design option to the exposed water-leg seals shown in FIG. 11. It is a heated drain pot with water leg seals built inside a chamber that is filled with steam. It is similar to that described in U.S. Pat. No. 4,903,491 to Larinoff.

Figure 13:
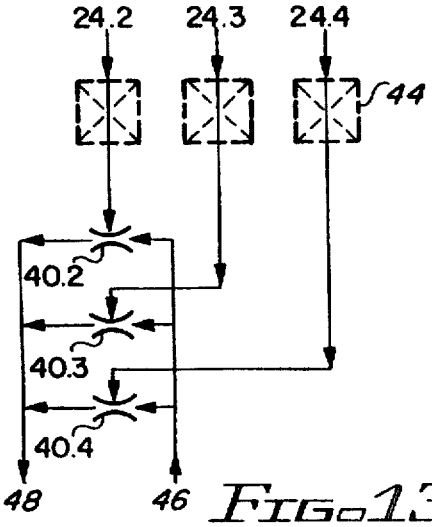
FIG. 13 shows the first-stage steam jet ejectors used to evacuate the gases from the bundle tube rows and a potential pre-condenser tube installed in each tube row.

Each of the non-condensible gas removal pipe lines operates at a different fluid pressure so that they too must be equalized before they can be removed from the system. FIG. 13 shows the gas flow through pipes 24.2, 24.3, 24.4 being removed by first-stage ejectors 40.2, 40.3, 40.4 with high pressure steam 46 and the discharged mixture 48 flowing to the inter-condenser of a conventional two-stage ejector system.

Figure 14:
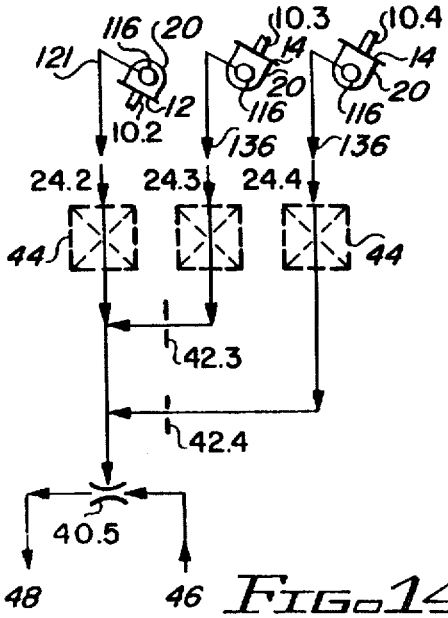
FIG. 14 shows a single first-stage steam jet ejector with orifice plates that are used to evacuate the gases from the bundle, suction spargers installed inside the rear headers and a potential pre-condenser tube in each tube row.

A lower cost gas evacuation system is shown in FIG. 14 as an option where only a single first-stage ejector 40.5 is used along with fixed orifice plates 42.3, 42.4. This is the subject referenced of U.S. Pat. No. 5,113,933 to Larinoff.

The non-condensible gas piping 24.2, 24.3, 24.4 is shown connected directly to the rear headers 20 in FIG. 3, FIG. 4, etc. An upgrade option to this simple gas evacuation means is the use of a rear header gas scavenger that employs a suction sparger pipe 116 described in U.S. Pat. Nos. 4,903,491 and 4,905,974 to Larinoff. The design of the suction sparger used inside the lower rear headers is described in '491 where the suction sparger pipe 116 is connected to pipe 136 and then to pipe 24.3 and similarly 24.4 as shown in FIG. 14. The design of the suction sparger used inside the upper rear header is described in '474 where the suction sparger pipe 116 is connected to pipe 121 and then to pipe 24.2.

Air-cooled pre-condenser tubes 44 are shown as an option in FIGS. 13 and 14 installed in the non-condensible gas removal piping 24.2, 24.3, 24.4. These pre-condenser tubes remove some of the steam flowing into the gas evacuation system. Removing this steam increases the efficiency of the first-stage ejectors by increasing the gas withdrawal rate. These pre-condensers are finned 11 tubing installed either inside or outside of the bundles in the fan air stream.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction, particularly the rear headers and tube sheets and the finned tube sizes, shapes and fin densities, and combinations and arrangements of parts may be resorted to without departing from the spirit and scope of the invention.

Now that the invention has been described,

What is claimed is:

1. An improved multi-row air-cooled bundle of tubes for steam condensing purposes installed with the tubes inclined, the tubes including a first row and supplemental upper warm rows which include a second pass reflux row and remaining isolated tube rows, employing blow-through steam being employed in the first row of the bundle where the steam and condensate flow in parallel while uncondensed steam leaving the first row is guided into the second pass reflux tube row where the uncondensed steam and condensate are counterflow and which is located in one of the upper warm rows of the bundle while the remaining isolated tube rows are of single pass design with divided rear headers where the steam and condensate flow in parallel, and where all the bundle rear headers have their condensate withdrawn through separate water-leg seals and their non-condensible gas piping isolated from each other with the gases withdrawn by separate individual means.

2. An improved four-row air-cooled bundle of tubes for steam condensing purposes that would be installed with its tubes inclined, the tubes including a first row and a last row with intermediate second pass reflux rows therebetween, blow-through steam being employed in the first and last rows of the bundle where the steam and condensate flow in parallel and the uncondensed steam leaving the first and last rows is guided into individual associated second pass reflux rows where the uncondensed steam and condensate are counterflow and which are located in the intermediate rows of the bundle, and where both of the bundle rear headers have their condensate withdrawn through separate water-leg seals and their non-condensible gas piping isolated from each other with the gases withdrawn by separate individual means.

3. An improved multi-row air-cooled bundle of tubes for steam condensing purposes comprising:

a plurality of tubes in a bundle, the bundle having its tubes arranged in a plurality of columns of tubes and a plurality of rows of tubes including a first row, a second row, a third row and a fourth row, each of the tubes being inclined with an upper end and a lower end;

a two-pass row of tubes having a first-pass row of tubes located in the first row of tubes for the downward passage therethrough of the steam and its condensate, such first row of tubes being exposed to ambient air for movement therepast;

the two-pass row of tubes having a second-pass row of tubes located in the second row and is parallel with the first-pass row of tubes for the upward passage therethrough of uncondensed steam flowing from the first-pass first row of tubes;

a second two-pass row of tubes having its first-pass located in the fourth row for the downward passage therethrough of the steam and its condensate, such fourth row of tubes being exposed to uncontrolled wind gusts;

the second two-pass row of tubes has its second pass row of tubes located in the third row and is parallel with the first-pass row of tubes, for the upward passage therethrough of uncondensed steam from the first-pass first row of tubes;

a front steam header adjacent to the upper ends of the tubes of the first-pass first row and for flowing steam to the first and fourth rows and for flowing additional steam to the second-pass tubes located in the second and third rows;

rear steam headers adjacent to the lower ends of the bundle tubes for receiving steam from the lower ends of the tubes of the first-pass row of tubes for feeding uncondensed stream upward into the second-pass row of tubes and for collecting the condensate from both the first-pass and second-pass rows;

rear gas headers adjacent to the upper ends of the second-pass tube rows for the collection of non-condensible gases released in both the first and second-pass tube rows;

separate and isolated water leg seals for the withdrawal of the condensate from each of the rear headers; and separate and isolated non-condensible gas withdrawal from each of the rear gas headers where the steam condensing terminates.

* * * * *